US007069861B1

(12) United States Patent
Robinson et al.

(10) Patent No.: US 7,069,861 B1
(45) Date of Patent: Jul. 4, 2006

(54) MICRO-SCALE FIRETRAIN FOR ULTRA-MINIATURE ELECTRO-MECHANICAL SAFETY AND ARMING DEVICE

(75) Inventors: Charles H. Robinson, Silver Spring, MD (US); Robert H. Wood, Laurel, MD (US); Mark R. Gelak, Columbia, MD (US); David Hollingsworth, Fallon, NV (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/708,930

(22) Filed: Apr. 1, 2004

Related U.S. Application Data

(60) Provisional application No. 60/320,097, filed on Apr. 8, 2003.

(51) Int. Cl.
*F42C 15/184* (2006.01)

(52) U.S. Cl. ..... 102/222; 102/229; 102/256

(58) Field of Classification Search ..... 102/222, 102/221, 231, 235, 244, 247, 254, 256, 262
See application file for complete search history.

(56) References Cited

U.S. PATENT DOCUMENTS

| | | | | |
|---|---|---|---|---|
| 3,686,934 A | | 8/1972 | Ferrand et al. | |
| 3,759,183 A | | 9/1973 | Apstein | |
| 3,812,783 A | | 5/1974 | Yang et al. | |
| 4,644,863 A | | 2/1987 | Bender et al. | |
| 4,986,184 A | * | 1/1991 | Kude | 102/256 |
| 5,536,988 A | * | 7/1996 | Zhang et al. | 310/309 |
| 5,585,592 A | * | 12/1996 | Stearns et al. | 102/233 |
| 6,167,809 B1 | * | 1/2001 | Robinson et al. | 102/235 |
| 6,211,598 B1 | * | 4/2001 | Dhuler et al. | 310/307 |
| 6,308,631 B1 | * | 10/2001 | Smith et al. | 102/254 |
| 6,314,887 B1 | * | 11/2001 | Robinson | 102/262 |
| 6,321,654 B1 | * | 11/2001 | Robinson | 102/251 |
| 6,374,739 B1 | * | 4/2002 | Smith et al. | 102/221 |
| 6,431,071 B1 | * | 8/2002 | Hodge et al. | 102/254 |
| 6,439,119 B1 | * | 8/2002 | Smith et al. | 102/221 |
| 6,497,180 B1 | | 12/2002 | Martin | |
| 6,568,329 B1 | * | 5/2003 | Robinson | 102/231 |

OTHER PUBLICATIONS

MIL-HDBK-777, Oct. 1, 1985, Fuze Catalog-Procurement Standard and Development Fuze Explosive Components, Chapter 2, USA.

* cited by examiner

*Primary Examiner*—Michael J. Carone
*Assistant Examiner*—Bret Hayes
(74) *Attorney, Agent, or Firm*—John F. Moran

(57) ABSTRACT

A microscale firetrain for a safe and arm device having a safe position and an armed position, the firetrain including an input explosive column having a longitudinal axis; a transfer charge having a longitudinal axis and first and second ends and movable from a safe position to an armed position; a receptor charge having a longitudinal axis that is non-collinear with and substantially parallel to the longitudinal axis of the input explosive column; wherein, in the safe position, the transfer charge is remote from both the input explosive column and the receptor charge; and wherein, in the armed position, the input explosive column is adjacent the first end of the transfer charge to thereby initiate the transfer charge, the longitudinal axis of the input explosive column is substantially perpendicular to the longitudinal axis of the transfer charge, the second end of the transfer charge is adjacent the receptor charge to thereby initiate the receptor charge and the longitudinal axis of the receptor charge is substantially perpendicular to the longitudinal axis of the transfer charge.

27 Claims, 7 Drawing Sheets

MICRO-SCALE FIRETRAIN FOR ULTRA-MINIATURE ELECTRO-MECHANICAL SAFETY AND ARMING DEVICE

CROSS REFERENCE TO RELATED APPLICATIONS

This application claims the benefit under 35 USC 119(e) of U.S. provisional patent application 60/320,097 filed Apr. 8, 2003, the entire file wrapper contents of which are herein incorporated by reference as though fully set forth at length. In addition, U.S. nonprovisional patent application Ser. No. 10/248,972 filed on Mar. 6, 2003 and entitled "Miniature MEMS-Based Electro-Mechanical Safety and Arming Device" is hereby incorporated by reference.

FEDERAL RESEARCH STATEMENT

The inventions described herein may be made, used, or licensed by or for the U.S. Government for U.S. Government purposes.

BACKGROUND OF INVENTION

The invention relates to a micro-scale firetrain (MSF) for MEMS (microelectromechanical system) based electromechanical safety and arming (S&A) devices. The invention significantly reduces the volume and cost over similar-functioning macro-scale initiating firetrains, while also reducing the amount of lead-bearing compounds associated with the firetrain.

The principal application of the invention is in munition fuze safety and arming for gun-launched and other tube-launched munitions, wherein, typically, launch (setback) acceleration and spin-induced centrifugal acceleration are sequentially detected, thresholded, and utilized to effectuate mechanical arming of a firetrain. More generally, this invention applies to any safety-critical explosive device or system, such as an ammunition fuze safety and arming device (S&A), in which the explosive firetrain mass, volume, and firing energy need to be minimized and the explosive firetrain needs to be kept in a safe condition prior to intended firing. Other applications of the present invention are for safety and arming in grenades, mortars, tank rounds, rockets and submunition grenades, mines, torpedoes and other weapons.

U.S. Pat. Nos. 3,686,934, 3,759,183, 3,812,783, 4,644,863 and 6,497,180 generally describe an electrically-initiated detonator (in particular, U.S. Pat. No. 3,686,934) in the form of a cylindrical enclosure (a cup), formed with one end closed and the other end open, filled with a first layer of secondary explosive, a second layer of primary explosive, and topped with an explosive header that is crimped in place to seal the cup. The header has a spot-welded heater wire (bridgewire), which is generally painted with a sensitive explosive primary mix for initiation, and contact electrodes of some kind. The detonator is then used in a mechanical S&A system wherein it functions as an explosive initiation member between an initiation stimulus (fire pulse from fuze circuit) and an acceptor charge, sometimes called a "lead charge".

In these prior designs, the sealed assembly including the cylindrical enclosure, the explosive fill, the header and bridgewire, etc., constitutes an electric detonator whose position relative to an input stimulus and an output firetrain is managed by the mechanism of a mechanical safety and arming (S&A) device. Because the detonator is large and massive (compared to the MEMS mechanism-based implementation of the present invention), the S&A mechanism must also be large.

To elaborate further, prior-art electric detonators and explosive initiation systems are all of a similar construction, including a current-pulse generating fire circuit, an electrical-contact header, a resistively-heated hot-wire bridge or thin-film element, a glass or plastic seal between header and cup, and an explosive-filled cup. In general, the header comprises concentric metal contacts electrically coupled through a bridgewire but otherwise electrically separated by a glass or plastic seal from the explosive cup. The bridgewire is painted with a sensitive primary explosive mixture such as lead styphnate. The header is pressed and crimped into a cup that has been previously loaded with first a secondary explosive for output and a primary explosive transfer charge on top of the secondary as described above. The cup generally has a coined bottom membrane. When a current is passed across the contacts through the sealed device, the bridge wire undergoes resistive heating, initiates the first primary explosive, which initiates the second primary explosive, which initiates the output fill, which shears and throws the coined metal cup-bottom at high velocity across a gap into a receiver explosive, which is detonated thereby.

There are variations among the cited prior-art patents from the general case described above. U.S. Pat. No. 3,759,183 combines an instantaneous electric detonator with a delay electric detonator tandemly in a single structure. U.S. Pat. No. 3,812,783 describes a detonator that is initiated optically instead of electrically. U.S. Pat. No. 4,644,863 describes a detonator with an electrically insulated casing and pole piece. Finally, U.S. Pat. No. 6,497,180 describes a detonator in which the heater wire or bridgewire of other designs is replaced by a carbon film resistor. In all these cases the detonators comprise essentially the same overall construction as was noted above. In every case, the metal cup or enclosure is quite large compared to the corresponding movable element of the present invention.

Typically an electric detonator or initiator such as the M100 is assembled as a self-contained unit into a mechanical safe and arm (S&A) system of a weapon, by dropping it into a hole in a slider or rotor that is able to move it—by translation or rotation—to control the mechanical arming status of a firetrain. The S&A mechanism functions by holding the detonator away from (out of line with) downstream elements of a firetrain, such as a so-called lead charge or a booster charge, until a weapon is launched. Upon detecting a valid launch, the S&A mechanism places the detonator in a position in-line with an explosive firetrain, which arms the weapon. Such movement usually involves translation of a slider or rotation of a rotor.

In this process, the whole detonator is moved to and fro as an explosive transfer element. Often the leads are the explosive train elements that are moved from an out of line position to an in line position. The leads are out of line in a rotor that mechanically blocks transfer of the detonator's explosive output to the S&A's output leads; the detonator remains stationary, since it is connected by lead wires to the firing circuit. This manipulation requires a relatively large mechanism, since the typical detonator body is comprised of a cylinder approximately 0.25 inches in length by 0.1 inches in diameter. Some newer detonators are shorter, of approximately 0.19 inches in length, and a little smaller in diameter. Nonetheless, these dimensions and the need for a transport mechanism still larger than the detonator itself set a practical limit on how small a conventional type mechanical S&A system can be made.

The present invention radically revises that physical limit by reducing the size of the movable element in the initiating explosive train. For example, the volume of the movable transfer charge used in the present invention is about 150 times smaller than the analogous movable element, typically a detonator such as the M100. Because the inventive firetrain transfer element is so small, the mechanism necessary to control and move its position for arming can be correspondingly small, whereby miniaturization of the entire S&A device is made possible.

Also, traditional assemblies often require the use of an explosive barrier capable of stopping the output of the whole M100 detonator. This requirement adds considerable mass and the need for a strong structure. A system with the present invention however must only present a barrier or a gap that can stop the output of a far smaller transfer charge, greatly reducing the need for ancillary structure.

In one embodiment, the present invention entails a movable transfer charge that contains no primary (sensitive) explosives and therefore is less hazardous to load, handle, and use, than the M100. This is because during assembly of the present invention into a MEMS S&A structure such as that cited earlier no significant amount of secondary explosive is ever in-line with (juxtaposed against or near) sensitive primary explosives, making it much safer than prior-art S&A assemblies to handle. In addition, the inventive micro-scale firetrain as a whole contains much less primary explosive than the M100 detonator.

Prior-art detonators for S&As are unsatisfactory, compared with the current invention, because they are larger, and require tight tolerances as well; also layered press loads. They typically use expensive-to-manufacture spot-welded bridge wires to initiate the first reaction, whereas the present invention uses wafer-based batch-produced thin-film-bridge chips. The comparatively sizable explosive output of a standard detonator requires a larger distance between the armed/not-armed states inside the mechanical S&A, forcing the assembly to be larger. At the same time, because such an assembly must of necessity have relatively large gaps between conventionally-manufactured working parts, the detonator must be powerful enough to operate across those gaps. Prior art detonators require a larger quantity of primary explosive to be handled on the detonator and fuze assembly line, which increases the safety hazard to production-line personnel. Prior art detonators use a larger quantity of lead-containing primary explosives, which has adverse health and environmental impacts during both manufacture and in-service functioning.

The present invention meets the need for an ultra-miniature firetrain that can be implemented in a MEMS-based safety and arming device or more generally in an ultra-miniature mechanical-logic/explosive-coupled assembly. The invention has the potential to reduce the dependence of the military on traditional detonators such as the M100 electric detonator, which are relatively bulky and expensive. The invention also significantly reduces the output of lead-containing byproducts of the explosive initiation when compared to the output of a conventional detonator such as the M100 electric detonator. One problem solved by the invention is the need for smaller and cheaper S&As to increase weapon lethality and affordability, by virtue of eliminating the standard detonator and implementing the functions of the detonator and mechanical safety logic within the miniature S&A mechanism itself. The invention also provides feasible ultra-miniature explosive components suitable for assembly in an explosive train applicable to the MEMS scale.

Compared to the prior art, the invention has differences that give beneficial results. One principal difference is miniaturization. New applications are possible because the radical miniaturization of the explosive train elements yields a corresponding miniaturization of the S&A mechanism needed to transport the moving transfer charge and also a corresponding reduction in the distance (stroke) necessary to separate safe and armed conditions, hence a much smaller overall structure. The present invention can be adapted to or employed in miniaturizing existing fuze S&As and circuits because the electrical input to initiate the MSF of the current invention is or can be identical to that of the standard M100 or similar detonators.

The invention provides a remedy for applications for safing and arming of miniature munitions where extremely small size is required. The greatly reduced explosive train volume allows for redundant explosive trains thereby increasing reliability. The greatly reduced fuzing volume creates volume for other munition functions/systems. Miniaturization has ancillary effects such as reducing the mass of the firetrain components, and also thereby the mass of the mechanism controlling the firetrain. Mass reduction improves implementations in situations such as impact and penetration environments, high vibration environments, and launch shock environments, in which a large-mass S&A would not only be subjected to potentially destructive loads but in which the large-mass S&A would subject its surrounding structures to potentially destructive loads.

With its greatly reduced size and mass, the MEMS S&A is also much easier to protect from high-G transients. Also, being smaller, the location options of the firetrain are increased. The ease of providing duplicate systems is increased, because the invention occupies only a fraction of the volume of large-scale S&As, thereby increasing explosive system reliability. Increased reliability means decreased dudding rate, which reduces the unexploded ordnance problem. Additionally, in high transient temperature environments, part of the volume freed up can be used to insulate against high temperature transients.

The inventive MSF employs conventional primary explosives upstream of the interrupter/movable transfer charge, but all other charges may be secondary explosives. The primary-explosive initiating charge (later referred to as the "input column") is stationary with no moving electrical contacts or connections required. The transfer charge (movable firetrain element) of the present invention contains, in one embodiment, only secondary (insensitive) explosives, and therefore may be safer to load, handle, and use than systems containing a movable element (e.g., M100 detonator) that contains primary explosives. Implementation of the present invention may include primary explosives in the transfer charge, if desired for some purpose. Relative to a standard electric-initiated detonator such as the M100 detonator, the invention eliminates more than 96% of the lead-containing primary explosives.

The invention includes advancements in safety in applications for small volume explosive systems where hand safety is required; in applications for small volume explosive systems where total munition safety is required; and in applications for high-G shock environments where minimization of mass is desirable. The movable transfer charge, in one embodiment, contains no primaries (primary, or sensitive, explosives), resulting in safer handling. The present invention (the MSF) classifies as an interrupted explosive train because the MEMS S&A mechanism physically retains the transfer charge out of line with other elements (the donor and the acceptor) of the firetrain until mechanical arming is achieved. The shape of the transfer charge necessitates, in one embodiment, two right-angle turns of the firetrain, which is hard for nature to imitate in the absence of the transfer charge. This is a safer design because the input and output explosive columns are never in-line. Transmission of detonation from input to output requires the presence of the coupling energetic transfer charge.

The present invention also achieves cost savings. There is reduced cost for S&A assembly including elimination of traditional detonator; reduced firing range cleanup costs because of reduced lead in MSF compared to electric detonators; reduced health hazard to manufacturers and firing range personnel because of reduced lead; cost savings from batch process MEMS fabrication/explosive loading/assembly; cost savings from reduced quantities of explosives in firetrain; and cost savings for configuration changes in future from batch nature of MEMS fabrication/assembly. The present invention can be less expensive in large-quantity production because it is amenable to in-situ and even wafer-scale slurry-loading or cast-loading techniques.

The present invention can be used with existing weapon systems such as the IAWS (XM29 Integrated Air Burst Weapon System) 25 mm grenade round fireset using the same firing parameters. The output of the MSF is able to detonate existing output explosive relays. The contemplated use of the MSF in the MEMS S&A complies with the safety requirements of MIL-STD-1316 and MIL-STD-331, Test D1. The MSF components individually and collectively have been shown to survive and function after experiencing launch shock levels of 45,000–65,000 Gs peak launch acceleration.

The invention includes a three-explosive-component out-of-line explosive train including a stationary input charge, a movable transfer charge, and a stationary receiver/output charge, with a total volume of explosives (the three components) less than about 0.002 cubic centimeters. The input and movable elements of the train comprise less than about 0.0012 cubic centimeters. The explosive transfer charge is detonable by an input explosive charge of 0.001 cubic centimeters volume or less. Novel configurations for the separation of explosive components maintains safety in out-of-line (safe) conditions.

BRIEF DESCRIPTION OF DRAWINGS

The invention will be better understood, and further objects, features and advantages thereof will become more apparent from the following description of the preferred embodiments, taken in conjunction with the accompanying drawings, in which.

DETAILED DESCRIPTION

Figure 1:
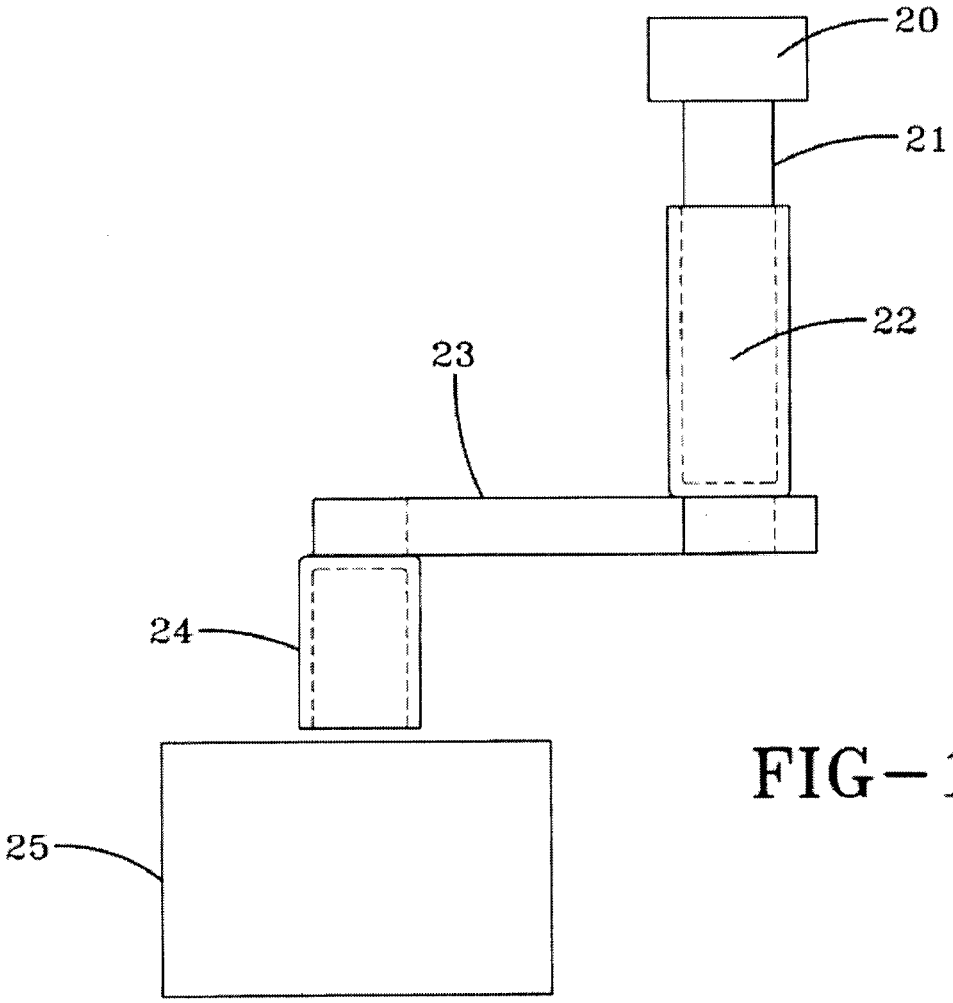
FIG. 1 is an elevation view of one embodiment of a microscale firetrain (MSF) according to the invention.

In the drawings, which are not necessarily to scale, like or corresponding parts are denoted by like or corresponding reference numerals.

Figure 2:
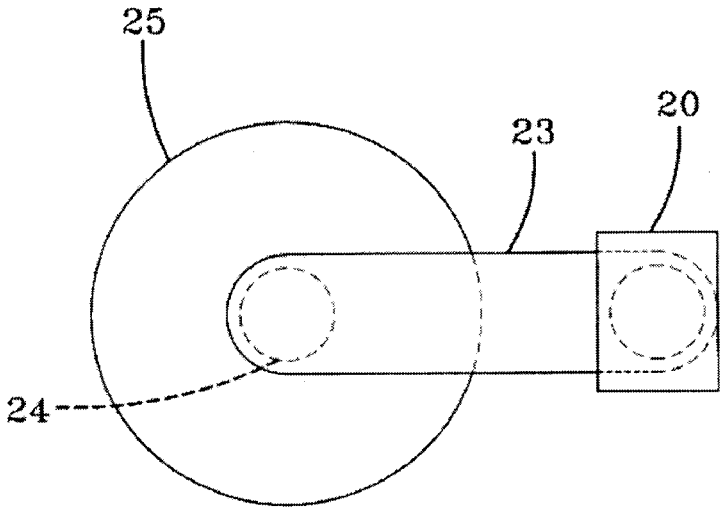
FIG. 2 is a plan view of the embodiment of FIG. 1.

FIG. 1 is an elevation view of one embodiment of a microscale firetrain (MSF) according to the invention. FIG. 2 is a plan view of the embodiment of FIG. 1. The embodiment of FIGS. 1 and 2 is an electrically-initiated and mechanically interrupted micro-scale firetrain (MSF) for MEMS-based mechanical safety and arming devices used in small- medium- and large-caliber ammunition fuzes (however, the invention is not restricted to ammunition fuzes). The MSF includes an electric initiator chip 20, an initiating spot charge 21, an input explosive column 22, a lateral transfer charge 23, a receptor charge 24, and an output charge 25. The MSF may be integrated into the architecture of a MEMS-based mechanical S&A assembly such as disclosed in U.S. patent application Ser. No. 10/248,972 filed on Mar. 6, 2003 and entitled "Miniature MEMS-Based Electro-Mechanical Safety and Arming Device".

The explosive output of charge 25 is approximately equivalent to the output of a standard M100 electric detonator, yet the total content of explosives is typically less than one half of that contained in a M100. In FIG. 2 the MSF is shown in a plan view wherein transfer charge 23 is seen coupling the output of input explosive column 22, across a lateral displacement to initiate receptor charge 24, which in turn initiates the output charge 25 below it.

Figure 3:
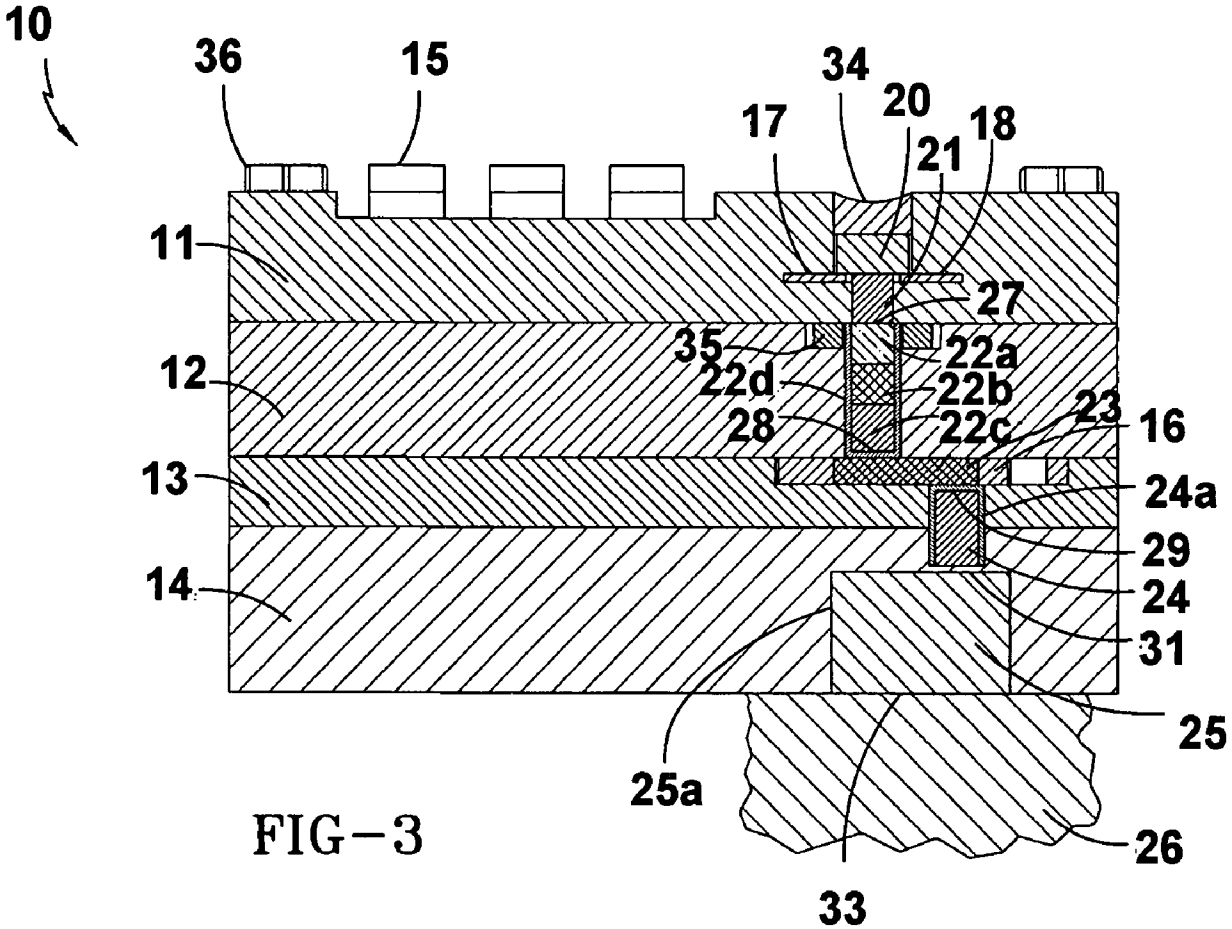
FIG. 3 is a cross-sectional elevation view of a MEMS safe and arm assembly, taken along the line A—A in FIG. 4, and including the firetrain of FIGS. 1 and 2.
Figure 4:
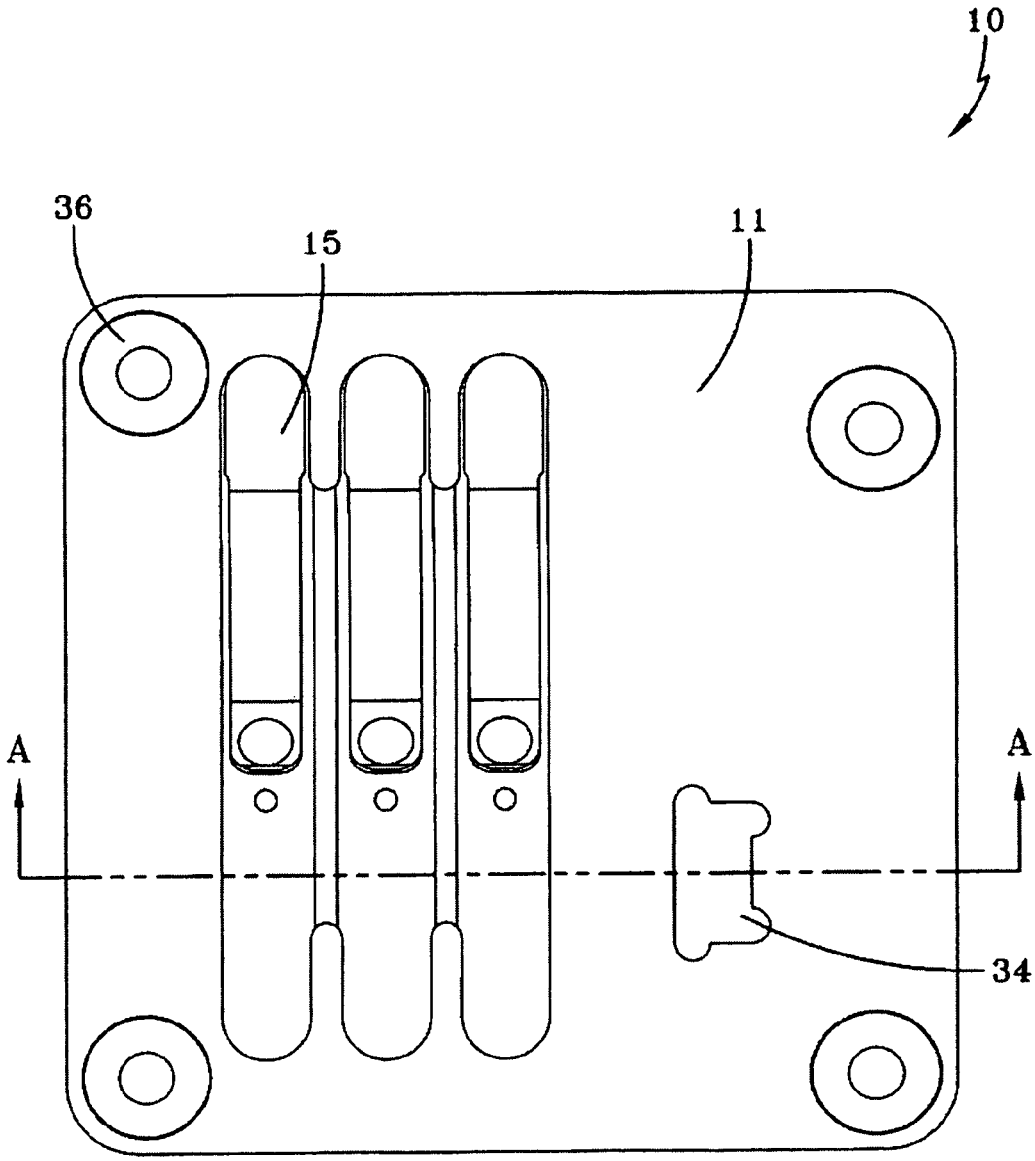
FIG. 4 is a plan view of a MEMS safe and arm assembly.

FIG. 3 is a cross-sectional elevation view of a MEMS safe and arm assembly 10, taken along the line A—A in FIG. 4, and including the firetrain of FIGS. 1 and 2. FIG. 4 is a plan view of a MEMS safe and arm assembly. FIG. 3 shows how the MSF of FIGS. 1 and 2 is integrated with a MEMS-based mechanical S&A assembly 10. In the shown implementation, initiator board assembly 11 integrates with fuze electronics (not shown) via electrical contacts 15, and is sandwiched below with cover plate assembly 12. Cover plate assembly 12 integrates on its lower side with MEMS-based S&A device 13. On its lower side the MEMS device 13 interfaces with an explosive output base assembly 14. Note that assemblies 11 through 14, which are held together by a clamping or joining means signified in FIG. 3 by bolt-and-nut assemblies 36, serve to position and confine the elements of the MSF. FIG. 4 shows a plan view of a representative MEMS-based S&A assembly 10 in which assembly posts 36, electrical contacts 15, and the pressure seal fill 34 overtop initiator chip 20 are shown.

Initiator chip 20 possesses on its substrate surface a resistive heating element type bridge which is electrically connected via a first electrical trace 17 and a second electrical trace 18 to at least two of the contacts 15 which communicate with the fuze firing circuit. The bridge and substrate are so designed to exhibit a temperature rise of sufficient magnitude and slope given a specific electric energy and power delivered by the fuze circuit as to initiate sustained reaction of the spot charge 21 and meet related fuze performance requirements such as function time. The electric firing energy sensitivity and performance are application specific requirements.

The resistive heating element bridge of initiator chip 20 is painted with a spot charge 21 of sensitive primary explosive used to initiate firetrains. The spot charge 21 creates and amplifies a combustion reaction from the hot bridge of the initiator chip 20 and subsequently produces an explosive output sufficient to initiate input explosive column 22, with which it is in close physical contact. Spot charge 21 and charge 22*a* form a first explosive interface 27.

Input explosive column 22 is comprised of a stack of explosives, typically loaded into a small metal cup 22*d* with an output membrane at the bottom. Input explosive column 22 escalates the explosive reaction from a deflagrating front at the beginning to a detonating output at the end. The method of explosive loading can include any combination of pre-pressed pellet, pre-cast pellet, poured in explosive, consolidated in place (pressed) explosive, in-situ generated explosive, etc. The stackup of increments 22*a*, 22*b*, and 22*c* is used to ramp up the explosive energy from the spot charge 21, initiated by heat from the initiator chip 20, to the final "output" increment of the input explosive column so that there is sufficient explosive energy to initiate the transfer charge 23 through the second explosive interface 28. However, other arrangements may serve the same purpose with greater or fewer different increments in the stack, as needed to tailor the output or as space is available. The entire input explosive column 22 preferably has a diameter in the range of about 0.015 to about 0.05 inches and a length in the range of about 0.05 to about 0.10 inches.

In a preferred embodiment, starting at the open end (next to spot charge 21) is a first fill 22*a*, which is typically a primary explosive composition. Charge 22*a* ramps up the explosive energy to initiate a less sensitive but more powerful incremental charge 22*b*. Charge 22*b* is typically made of primary explosives, formulated and conditioned to a density that gives a more powerful output than what was received from charge 22*a*, in order to initiate incremental charge 22*c*. Charge 22*c* is typically a suitable secondary explosive that is a high-output explosive capable of small-diameter initiation, for example, CL-20 with a binder. Upon initiation, charge 22*c* projects a detonating output through the bottom of the cup 22*d* and initiates transfer charge 23 (assuming the S&A device 13 is mechanically armed). The bottom of cup 22*d* may function as a flyer plate. A mechanical seal 35 may be provided around the upper portion of column 22.

Explosive loading cup 22*d* is provided as an expedient means to contain, handle, and load the input explosive column 22. However, input explosive column 22 can also be loaded by consolidating explosive directly into a hole machined in the cover plate 12, with a foil membrane interface to charge 23. The thin metal bottom of cup 22*d* and the air gap that provides working clearance for the arming mechanism (such as a slider) to move transfer charge 23 together constitute a second explosive interface 28 between charges 22 and 23.

The detonating output of input explosive column 22 bursts through interface 28 and initiates one end of laterally disposed transfer charge 23. Transfer charge 23 is an explosive charge held captive within a pocket or slot in an arming mechanism, such as arming slider 16, and is preferably made of a suitable high-output secondary explosive capable of small-diameter initiation, such as CL-20 with a binder. Transfer charge 23 may also be made of a primary explosive, if the particular application requires. The purpose of charge 23 is to transfer a detonation reaction laterally from the input axis of explosive interface 28 to the non-collinear output axis of the receptor charge 24 through explosive interface 29. Note that transfer charge 23 diverts the direction of the explosive reaction by 90 degrees at interface 28, and then diverts it back 90 degrees at interface 29. As described in U.S. patent application Ser. No. 10/248,972, when the arming slider is in the armed position, the transfer charge 23 is aligned with the input column axis at one end and with the receptor charge axis at the other. When it is in the safe position it is aligned with neither axis. Charge 23 may comprise a pressed or pre-formed explosive pellet, dropped into the arming slider pocket, or it may be pressed, cast or slurry-loaded into the pocket. Charge 23 preferably has a length in the range of about 0.050 to 0.15 inches long, a width in the range of about 0.015 to 0.050 inches, and a thickness in the range of about 0.008 to 0.030 inches in the MEMS device 13 plane.

The explosive detonation initiated in the transfer charge 23 at one end (interface 28) rapidly progresses laterally to the other end, where its explosive output bursts across a third explosive interface 29, consisting of a metal or plastic membrane, and impinges explosively into the top of receptor charge 24, detonating it. Any suitable means can be used to move transfer charge 23 from the safe to the armed position, i.e., launch acceleration, spin, manual setting, electromechanical actuation, magnetic actuation, thermal expansion device, thermal bimetal actuation, piezoelectric actuator, memory metal actuator, etc.

Receptor charge 24 receives the explosive output of transfer charge 23 and continues the reaction, amplifying it as it proceeds to initiate output charge 25. Receptor charge 24 is made of a suitable high-output secondary explosive, pressed to a specified density into receptor cup 24*a*. The cup 24*a* is there for expediency of handling and confinement. Configurations in which charge 24 is pressed into a blind hole in the MEMS S&A device 13 substrate can also be used. The output of the receptor charge 24 bursts across a fourth explosive interface 31, typically an air gap, and impinges explosively into the top of an output charge 25, which typically is a secondary explosive. Receptor charge 24 preferably has a diameter in the range of about 0.015 to 0.05 inches and a length greater than about 0.030 inches.

Output charge 25 is made of a suitable high-output secondary explosive, and may be loaded into a cup or may be cast-molded or pressed into the output charge cavity 25*a*. Output charge 25 continues and expands upon the output of charge 24. In FIG. 3, the centerline of the receptor charge 24 is shown offset laterally from the centerline of the output charge 25 to demonstrate that symmetry at this location is not required for operation of the firetrain. The explosive transfer from the receptor charge 24 to the output charge 25 constitutes a buildup of explosive output, resulting in a powerful detonating output from output charge 25 that bursts through a fifth and final explosive interface 33 that typically consists of a metal foil layer, and into an explosive acceptor 26, sometimes called a relay, lead, or booster charge, external to the S&A assembly 10. The output charge 25 can be sized to meet specific application requirements.

The explosive composition of the various charges 22 through 25 and the localized density created by the pressing and loading operations are such that one of ordinary skill in the art will be able to replicate a detonation transfer through the aligned components of the firetrain and into the output charge 25. While this description affords specifications for a system that has been successfully demonstrated, the exact values and combinations that will be successful depend on various factors, including the size of the mechanical interface gaps. It will be appreciated that the same firetrain, by replacing detonation transfer materials with deflagration propagating materials, could be used to simply initiate and propagate a deflagration wave to accomplish some purpose (for example, a squib type function).

The invention can replace existing firetrain initiation control systems that are sized to move and position a standard M100-type detonator with a new type of firetrain initiation control system that is far smaller and whose arming status can be managed using MEMS-scale (versus macro-scale) structures. An important feature of the invention is that a necessary part (transfer charge 23) of the explosive firetrain is controlled separately from the other parts and that the initiating portion of the firetrain is always mechanically out of line with the output portion of the firetrain.

The input explosive column 22 is preferably a combination of primary and secondary explosives and has a longitudinal axis that is parallel to, but laterally displaced from, the longitudinal axis of the receptor charge 24. The transfer charge 23, when in the safe position, is lined up neither with the input explosive column 22 nor with the receptor charge 24. The MEMS arming mechanism actually forms a barrier between the input explosive column 22 and the receptor charge 24, when in the safe position. The lateral offset between the input explosive column 22 and the receptor charge 24 is such that if the entire MEMS arming mechanism is omitted from the assembly 10, the input explosive column 22 is small enough that it is not capable of initiating or damaging the receptor charge 24. When the MEMS arming mechanism is in its armed position, the input explosive column 22 and the receptor charge 24 are explosively connected only through the transfer charge 23. The transfer charge 23 consists, in the preferred embodiment, only of secondary explosives. The explosive output of input explosive column 22 is, for example, a detonation wave (could also be a flyer plate of sufficient kinetic energy) that propagates through interface 28 and that initiates a laterally-traveling detonation wave in the transfer charge 23. The transfer charge 23, once initiated with a detonation wave, is capable of carrying the detonation reaction laterally along its length and then initiating a detonation wave at right angles to itself into the receptor charge 24. The invention can also be used to initiate and propagate a deflagration output only, for a squib-type application. In this case, charges 25 and 26 would be replaced with deflagrating-type charges.

The preferred way to assemble the components of the above-described embodiment is a slurry load of initiator spot charge 21, pressed powder for 22*c*, pressed powder for 22*b*, slurry load for 22*a* and pressed pellets, mechanically emplaced, for charges 23, 24 and 25.

Figure 5B:
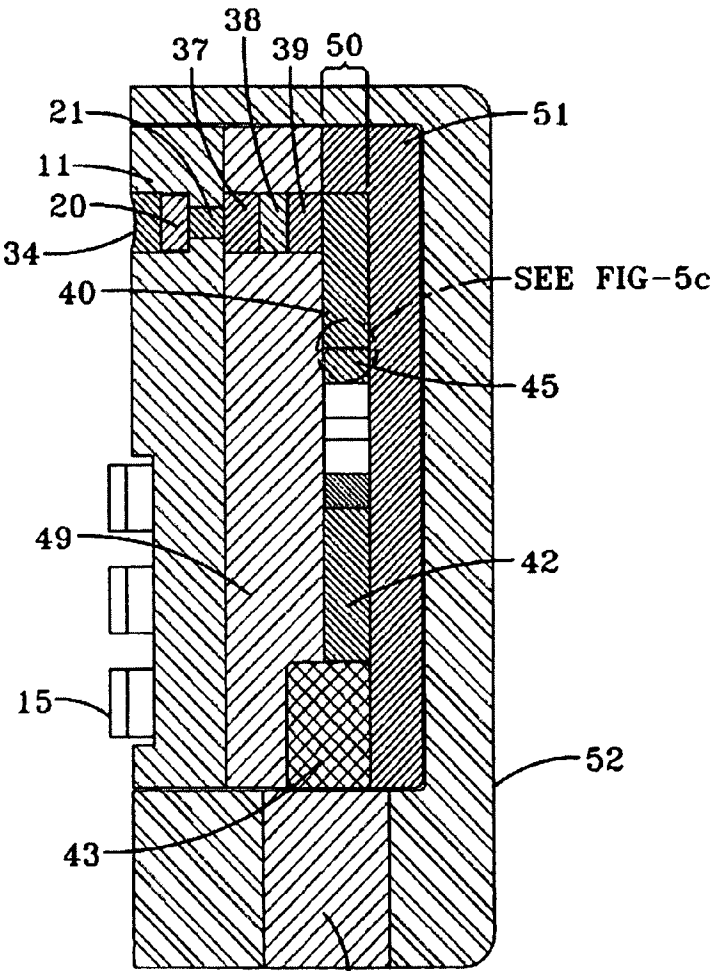
FIG. 5*b* is a cross-sectional elevation view taken along the line B—B of FIG. 5*a* and further including cover plate and initiator board assemblies.
Figure 5A:
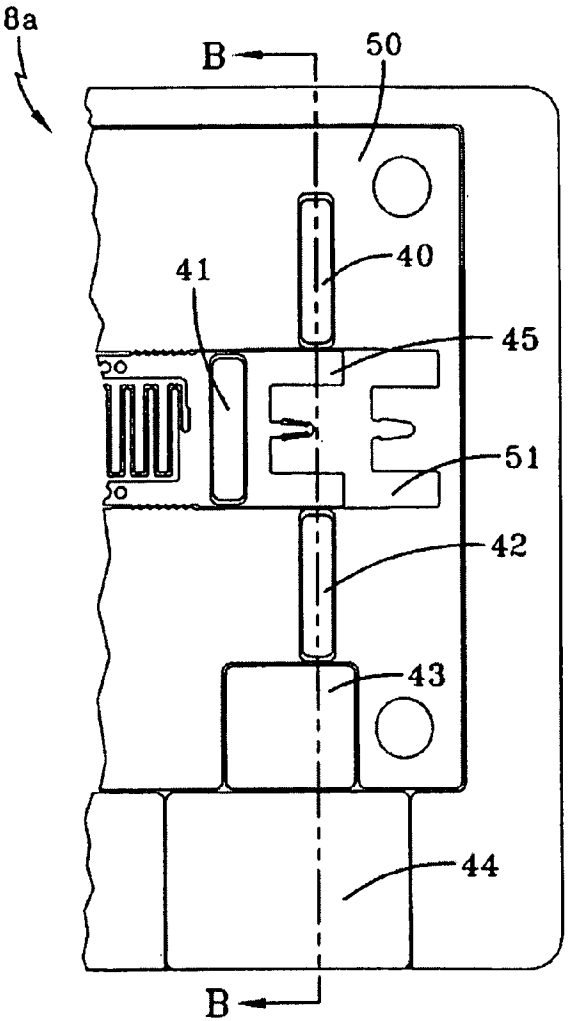
FIG. 5*a* is a plan view of a MEMS safe and arm assembly in the safe (unarmed) position and incorporating a second embodiment of a microscale firetrain according to the invention.
Figure 5C:
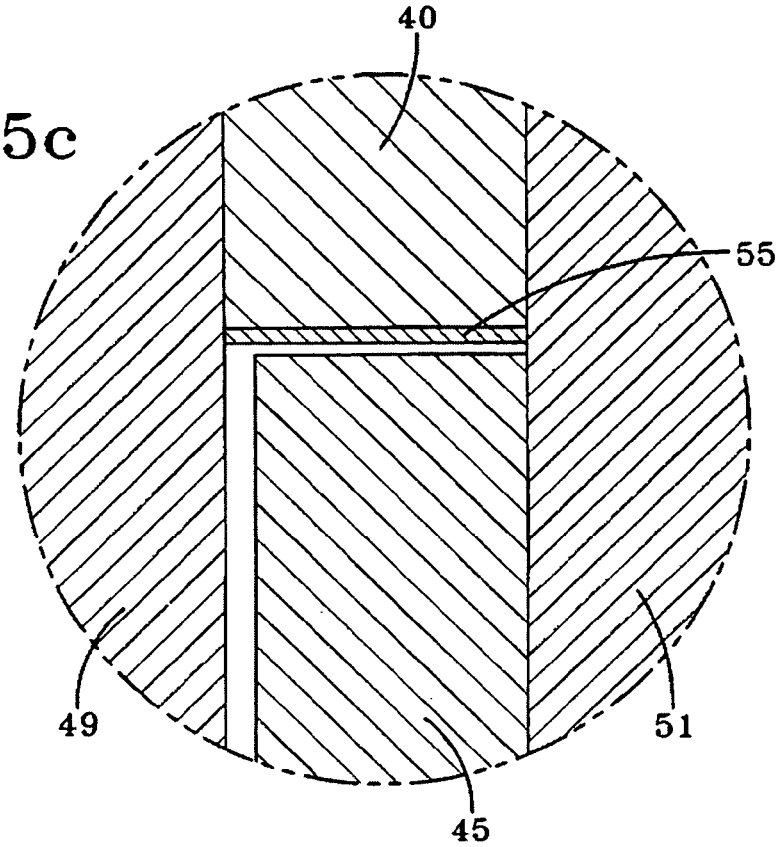
FIG. 5*c* is an enlarged view of a portion of FIG. 5*b*.

FIG. 5*a* is a plan view of a MEMS safe and arm assembly 8*a* in the safe (unarmed) position and incorporating a second embodiment of a microscale firetrain according to the invention. FIG. 5*b* is a cross-sectional elevation view taken along the line B—B of FIG. 5*a* and further including the cover plate and initiator board assemblies 49 and 11. FIG. 5*c* is an enlarged view of a portion of FIG. 5*b* showing the detail of the input charge 40 and arming slider 45 in the safe position.

A second preferred embodiment of a MEMS safe and arm assembly is shown in FIGS. 5*a* and 5*b*. In this embodiment, an explosive in-plane transfer charge 41 is disposed in the plane of the MEMS S&A device layer 50. Device layer 50 includes a movable arming mechanism, such as arming slider 45. The device layer 50 may rest on and include a substrate 51. FIG. 5*b* shows initiator board assembly 11, on top of cover plate 49, which rests against MEMS device layer 50. Layers 11, 49, 50, and 51 all stack and fit in output housing 52.

The beginning of the second embodiment of the firetrain is similar to that of the first embodiment. Along an axis that is normal to the plane of the S&A device layer 50, a resistively-heated bridge type electrical initiator 20 initiates spot charge 21. Spot charge 21 is made of a primary explosive such as lead styphnate. Spot charge 21 initiates the input explosive column that is loaded into the cover plate 49. The input explosive column includes a first primary-explosive charge 37 (such as lead azide) that is more powerful but less sensitive than spot charge 21, a second charge 38, made of a more powerful primary or secondary explosive charge than charge 37. The third and most powerful input column charge 39 is a powerful secondary explosive mix, such as CL-20 with a binder. The purpose of charges 37, 38, and 39 is to build up an explosive detonation front to detonate the in-plane input charge 40. Input charge 40 is typically a thin pressed pellet of a powerful secondary explosive mix, such as CL-20 with a binder. Input charge 40 is disposed in a slot that is part of the MEMS device layer 50. The induced detonation wave in charge 40 travels laterally (in-plane) along the substrate from the distal end and toward the arming slider 45. When the arming slider 45 is in its safe position, shown in FIGS. 5*a*, 5*b* and 5*c*, the reaction ends with the consumption of charge 40.

Figure 6C:
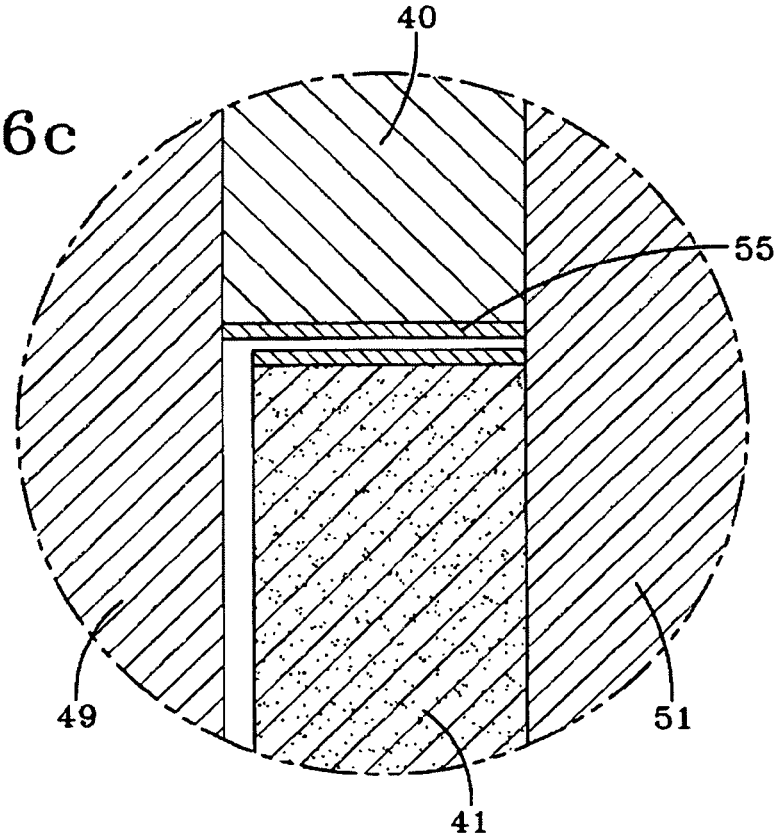
FIG. 6*c* is an enlarged view of a portion of FIG. 6*b*.
Figure 6B:
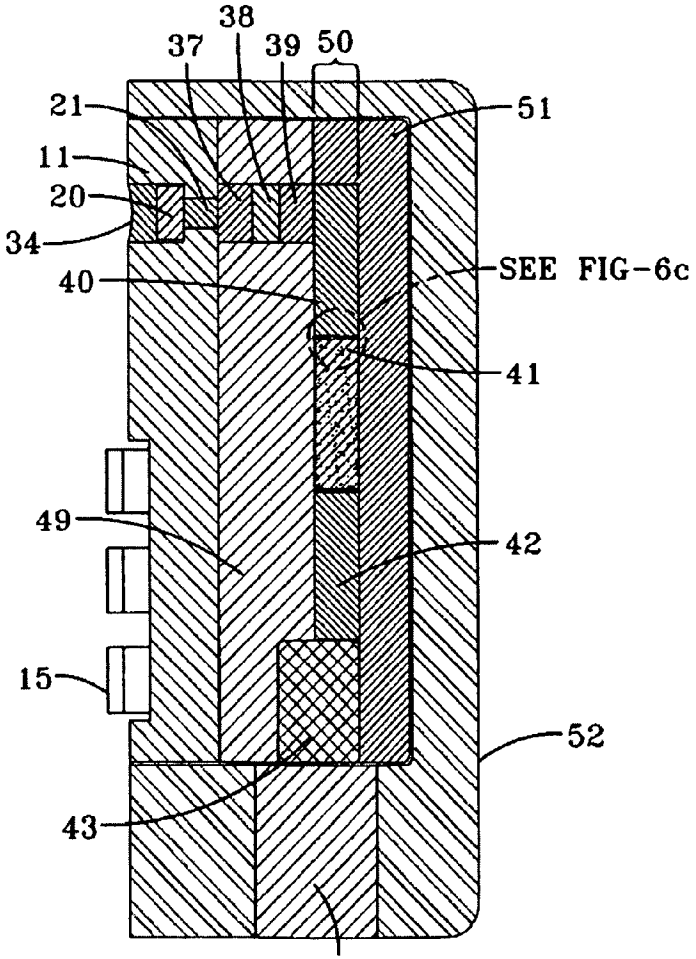
FIG. 6*b* is a cross-sectional elevation view taken along the line D—D of FIG. 6*a* and further including the cover plate and initiator board assemblies.
Figure 6A:
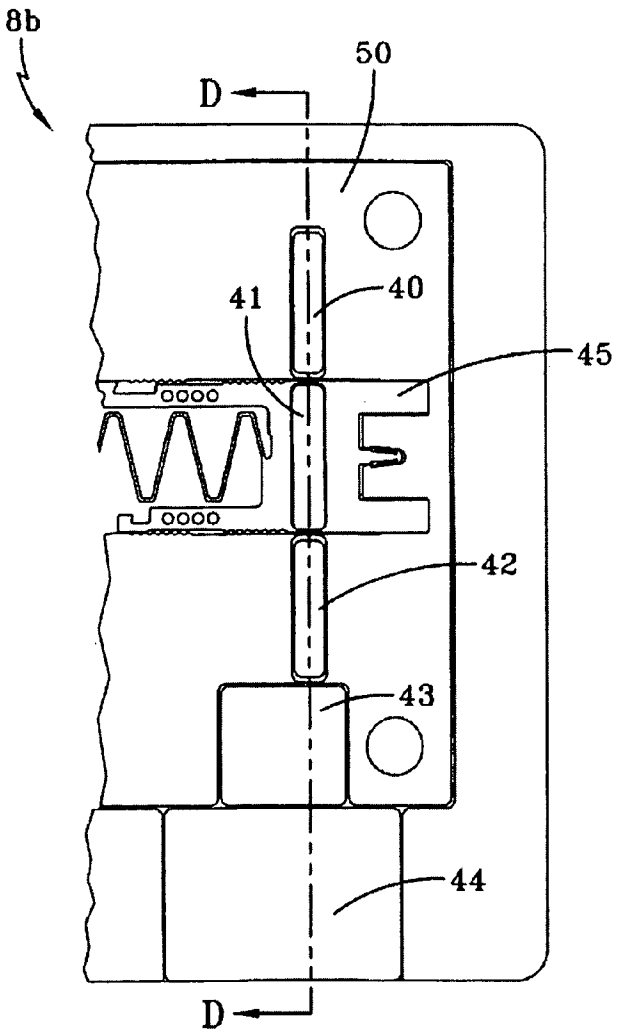
FIG. 6*a* is a plan view of the safe and arm assembly of FIG. 5*a* in the armed position.

FIG. 6*a* is a plan view of the safe and arm assembly 8*a* of FIG. 5*a* in the armed position. FIG. 6*b* is a cross-sectional elevation view taken along the line D—D of FIG. 6*a* and further including the cover plate and initiator board assemblies. FIG. 6*c* is an enlarged view of a portion of FIG. 6*b*. When the arming slider 45 is in its armed position as shown in FIGS. 6*a*, 6*b* and 6*c*, the detonation front passes laterally through the thin side walls of the device layer frame 55 (FIG. 6*c*), then across the small gap to the thin wall of the arming slider 45 where it energetically impinges endwise upon the in-plane transfer charge 41 and detonates it. The output of transfer charge 41 is collinear with in-plane receptor charge 42, which is another in-plane secondary explosive pellet. Transfer charge 41 detonates in-plane receptor charge 42 by blasting through a second thin wall of the pocket in the arming slider 45, across the gap, through the thin side wall of device layer frame 55, and into first in-plane output charge 43, detonating it. Transfer charge 41 and receptor charge 42 are typically pressed or formed pellets of a secondary explosive compound, preferably one that has a high-output explosive and is capable of small-diameter initiation, such as CL-20 with a binder. Charges 41 and 42 are preferably of the same dimensions and material as charge 40, for interchangeability. Alternatively, charge 40 and 41 may consist of a primary, rather than secondary, explosive mix. First in-plane output charge 43 then fires into a second in-plane output charge 44, detonating it. The output of charge 44, which is typically a cylindrical shape and comprised of secondary explosives, is approximately equivalent to that of an M100 detonator. Preferably, the combined volume of charges 37, 38, 39, 40 and 41 is less than about 0.002 cubic centimeters.

In an accident scenario, however, as shown in FIGS. 5*a* and 5*b*, the arming slider 45 of the MEMS S&A assembly 8*a* will be in the safe position so that the in-plane transfer charge 41 and in-plane receptor charge 42 will not be affected by the inadvertent reaction and output of in-plane input charge 40. The output of input charge 40 in such a case will be wasted against a solid portion of the arming slider as shown and safety of the overall weapon system will be preserved by protecting in-plane receptor charge 42 from input that might otherwise propagate a reaction beyond the interrupter. What is more, if in-plane transfer charge 41 were somehow inadvertently ignited independent of input charge 40 when the arming slider was located in the safe position, the output of transfer charge 41 would also be wasted against an inert part of the frame, and thus in-plane receptor charge 42 would be protected and safety would be preserved. Additionally, if the entire slider 45 were missing, the output of charge 40 would not be able to operate across the long air gap of the slider track to initiate charge 42.

The outputs of in-plane transfer charge 41 and in-plane receptor charge 42 are intended to be an explosive detonation wave, but a similar firetrain could be used to simply initiate and propagate a deflagration wave to accomplish some purpose (squib type function). A preferred way to assemble the components of the second embodiment is a slurry load of initiator spot charge 21; pressed powder for charges 39 and 38; slurry load 37; and mechanically emplaced pressed pellets for charges 40, 41, 42, 43 and 44. Alternatively, charge 21 may be a grown (in situ) explosive, and charges 40, 41 and 42 can be a viscous explosive mix that is slurry-loaded or cast in place.

The second embodiment is advantageous for applications wherein an explosive output is desired to exit the assembly in a lateral, rather than normal, direction relative to the plane of the MEMS device layer 50. In addition, the second embodiment can be implemented in a thinner stack than can the first embodiment, because of the in-plane lateral direction of the output.

Figure 7B:
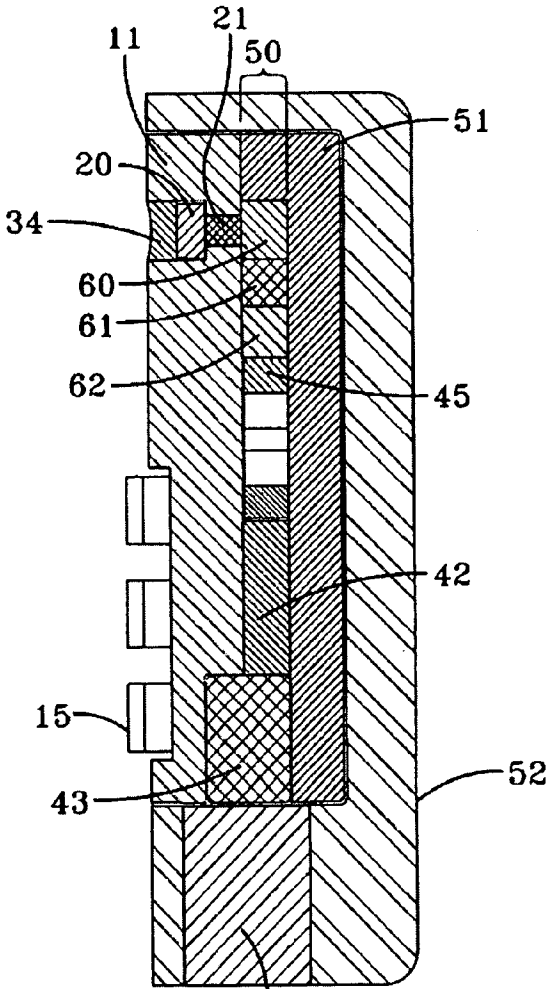
FIG. 7*b* is a cross-sectional elevation view taken along the line F—F of FIG. 7*a* and further including an initiator board assembly.
Figure 7A:
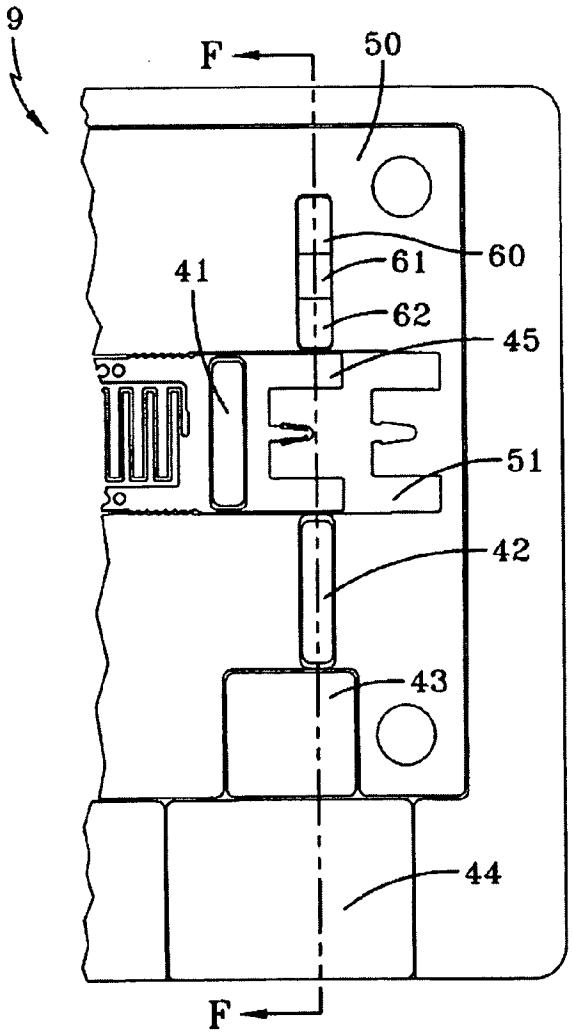
FIG. 7*a* is a plan view of a MEMS safe and arm assembly in the safe (unarmed position) and incorporating a third embodiment of a microscale firetrain according to the invention.

FIG. 7*a* is a plan view of a MEMS safe and arm assembly 9 in the safe (unarmed position) and incorporating a third embodiment of a microscale firetrain according to the invention. FIG. 7*b* is a cross-sectional view taken along the line F—F of FIG. 7*a* and further including the initiator board layer. Referring to FIGS. 7*a* and 7*b*, the explosive initiating buildup as well as the explosive transfer is disposed in the plane of the MEMS S&A device layer 50. Starting, as with the second embodiment, along an axis that is normal to the plane of the S&A device layer 50, the explosive activity begins with a resistively heated bridge on initiator chip 20 disposed in initiator board assembly 11. Chip 20 ignites spot charge 21 which in turn fires downward onto the plane of the MEMS S&A device layer 50. Spot charge 21 initiates an input explosive row comprising charges 60, 61 and 62. A cover plate assembly is not included in assembly 9.

Spot charge 21 directly initiates a first in-plane buildup charge 60. The first in-plane buildup charge 60 is a low density primary explosive mix and it fires into contiguous second in-plane buildup charge 61, which may be a higher density primary explosive mix, and which then fires into a third in-plane buildup charge 62, which is a more powerful secondary explosive mix, such as CL-20 with a binder. The output of charge 62 fires into transfer charge 41, which is carried by the arming slider and is lined up with the other charges when in the armed position. Explosive charges 41, 42, 43 and 44 are identical in design and function as that shown in the second embodiment. Preferably, the combined volume of charges 60, 61, 62 and 41 is less than about 0.0015 cubic centimeters.

In the armed position, the output of transfer charge 41 detonates in-plane receptor charge 42, which detonates first output charge 43, and which detonates second output charge 44. This latter part of the firetrain is identical to that of the second embodiment above and is not repeated here. The configuration of the third embodiment has the advantage that there is a simplification of the explosive loading because the cover plate and its columnar buildup charges 37, 38 and 39 are eliminated, and are replaced by a row of contiguously loaded in-plane build-up increments 60, 61, and 62. There is also a conservation of space in the stack-up of parts, due to the elimination of the cover plate.

Other advantages of the third embodiment include elimination of the cover plate assembly, which saves cost and volume; and simplified explosive loading by moving the input build-up charges in-plane. The third embodiment is also capable of initiating and propagating a deflagration output (squib type function). In the third embodiment, the output housing 52 replaces base 14 and clamping hardware 36 and the device enables casting of all explosive elements since each explosive cavity can be closed on all but a loading side. With suitable rearrangement, the bridge element can be deposited in position on the top of 51 and beneath 60, the 60 explosive can be replaced by the 21 explosive and 34, 20, and 60 can be eliminated, supplying further simplification and reduction of components/processes.

The various embodiments of the present invention are useful in, for example, miniaturized devices to initiate an explosive firetrain; miniaturized devices to provide an explosive/energetic event, for shock, heat, pressure, kinetic energy, chemical energy output; miniaturized devices to initiate a deflagration firetrain; in tube-launched weapons, grenades, mines, etc., provide miniature explosive elements to enable a MEMS-based mechanical safety and arming device to provide an output; in industrial applications such as mechanical logic and arming for explosive output for explosive bolts, blasting caps, actuators, self-destruct devices, rocket motor igniters, and gas generators, and miniature hand-safe blasting initiation systems; in weapons where lead content and the output of lead-containing products must be reduced; in applications where the overall amount of explosive needs to be reduced, for example to improve safety during manufacture, assembly, and testing; in applications where the overall amount of explosive needs to be reduced, for example for miniaturized device/system applications; in applications where the amount of primary explosives needs to be reduced, for example to improve safety during manufacture, assembly, and testing; and in applications where reduced mass of explosive components is desired.

While the invention has been described with reference to certain preferred embodiments, numerous changes, alterations and modifications to the described embodiments are possible without departing from the spirit and scope of the invention as defined in the appended claims, and equivalents thereof.

The invention claimed is:

1. A firetrain for a safe and arm device having a safe position and an armed position, the firetrain comprising:

an input explosive column having a longitudinal axis;

a transfer charge having a longitudinal axis and first and second ends and movable from the safe position to the armed position;

a receptor charge having a longitudinal axis that is non-collinear with and substantially parallel to the longitudinal axis of the input explosive column;

wherein, in the safe position, the transfer charge is remote from both the input explosive column and the receptor charge; and wherein, in the armed position, the input explosive column is adjacent the first end of the transfer charge to thereby initiate the transfer charge, the longitudinal axis of the input explosive column is substantially perpendicular to the longitudinal axis of the transfer charge, the second end of the transfer charge is adjacent the receptor charge to thereby initiate the receptor charge and the longitudinal axis of the receptor charge is substantially perpendicular to the longitudinal axis of the transfer charge.

2. The firetrain of claim 1 wherein the transfer charge comprises CL-20 with a binder and wherein a total volume of explosives in the transfer charge is less than about 0.0002 cubic centimeters.

3. The firetrain of claim 2 wherein a total volume of explosives in the input explosive column and the transfer charge is less than about 0.0012 cubic centimeters.

4. The firetrain of claim 2 wherein a total volume of explosives in the input explosive column is less than about 0.001 cubic centimeters.

5. The firetrain of claim 2 wherein the receptor charge consists of secondary explosives.

6. The firetrain of claim 2 wherein the input explosive column comprises first, second and third charges, the first charge initiating the second charge, the second charge initiating the third charge and the third charge initiating the transfer charge.

7. The firetrain of claim 6 wherein the first charge consists of primary explosive, the second charge consists of primary explosive and the third charge consists of secondary explosive.

8. The firetrain of claim 2 further comprising:

a spot charge disposed adjacent the input explosive column, for initiating the input explosive column;

an initiator chip disposed adjacent the spot charge, for initiating the spot charge; and an output charge disposed adjacent the receptor charge, the receptor charge initiating the output charge.

9. A safe and arm assembly having a safe position and an armed position, comprising:

an input explosive column having a longitudinal axis;

a transfer charge having a longitudinal axis and first and second ends and movable from the safe position to the armed position;

a receptor charge having a longitudinal axis that is non-collinear with and substantially parallel to the longitudinal axis of the input explosive column;

wherein, in the safe position, the transfer charge is remote from both the input explosive column and the receptor charge; and wherein, in the armed position, the input explosive column is adjacent the first end of the transfer charge to thereby initiate the transfer charge, the longitudinal axis of the input explosive column is substantially perpendicular to the longitudinal axis of the transfer charge, the second end of the transfer charge is adjacent the receptor charge to thereby initiate the receptor charge and the longitudinal axis of the receptor charge is substantially perpendicular to the longitudinal axis of the transfer charge;

a spot charge disposed adjacent the input explosive column, for initiating the input explosive column;

an initiator chip disposed adjacent the spot charge, for initiating the spot charge; an output charge disposed adjacent the receptor charge, the receptor charge initiating the output charge;

a base assembly having the output charge and a first portion of the receptor charge disposed therein;

a safe and arm device layer disposed atop the base assembly, the safe and arm device layer including an arming mechanism movable between the safe position and the armed position, the transfer charge being disposed in the arming mechanism and a second portion of the receptor charge being disposed in the safe and arm device layer;

a cover plate assembly disposed atop the safe and arm device layer and having the input explosive column disposed therein; and an initiator board assembly disposed atop the cover plate assembly and having the spot charge and the initiator chip disposed therein.

10. The safe and arm assembly of claim 9 wherein a total volume of explosives in the input explosive column, the transfer charge and the receptor charge is less than about 0.002 cubic centimeters.

11. The safe and arm assembly of claim 9 wherein a total volume of explosives in the input explosive column and the transfer charge is less than about 0.0012 cubic centimeters.

12. The safe and arm assembly of claim 9 wherein a total volume of explosives in the input explosive column is less than about 0.001 cubic centimeters.

13. The safe and arm assembly of claim 9 wherein the transfer charge consists of secondary explosives.

14. The safe and arm assembly of claim 9 wherein the receptor charge consists of secondary explosives.

15. The safe and arm assembly of claim 9 wherein the input explosive column comprises first, second and third charges, the first charge initiating the second charge, the second charge initiating the third charge and the third charge initiating the transfer charge.

16. The safe and arm assembly of claim 15 wherein the first charge consists of primary explosive, the second charge consists of primary explosive and the third charge consists of secondary explosive.

17. A safe and arm assembly having a safe position and an armed position, comprising:

an input explosive column having a longitudinal axis;

an input charge having a longitudinal axis and first and second ends, the input explosive column being substantially perpendicular to and adjacent the first end of the input charge;

a transfer charge having a longitudinal axis and first and second ends and movable from the safe position to the armed position;

a receptor charge having a longitudinal axis that is substantially collinear with the longitudinal axis of the input charge;

wherein, in the safe position, the transfer charge is remote from both the input charge and the receptor charge; and wherein, in the armed position, the second end of the input charge is adjacent the first end of the transfer charge to thereby initiate the transfer charge, the longitudinal axis of the input charge is substantially collinear with the longitudinal axis of the transfer charge, the second end of the transfer charge is adjacent the receptor charge to thereby initiate the receptor charge and the longitudinal axis of the receptor charge is substantially collinear with the longitudinal axis of the transfer charge;

a spot charge disposed adjacent the input explosive column, for initiating the input explosive column;

an initiator chip disposed adjacent the spot charge, for initiating the snot charges; an output charge disposed adjacent the receptor charge, the receptor charge initiating the output charge at the output;

a base assembly;

a safe and arm device layer disposed atop the base assembly, the safe and arm device layer including an arming mechanism movable between the safe position and the armed position, the transfer charge being disposed in the arming mechanism and the input charge and receptor charge being disposed in the safe and arm device layer;

a cover plate assembly disposed atop the safe and arm device layer and having the input explosive column disposed therein; and an initiator board assembly disposed atop the cover plate assembly and having the spot charge and the initiator chip disposed therein.

18. The safe and arm assembly of claim 17 wherein the input charge, transfer charge and receptor charge are substantially a same size.

19. The safe and arm assembly of claim 17 wherein the transfer charge consists of secondary explosives.

20. The safe and arm assembly of claim 17 wherein the receptor charge consists of secondary explosives.

21. The safe and arm assembly of claim 17 wherein the input explosive column comprises first, second and third charges, the first charge initiating the second charge, the second charge initiating the third charge and the third charge initiating the input charge.

22. The safe and arm assembly of claim 21 wherein the first charge consists of primary explosive, the second charge consists of primary explosive and the third charge consists of secondary explosive.

23. A safe and arm assembly having a safe position and an armed position, comprising:

an input explosive row having a longitudinal axis;

a transfer charge having a longitudinal axis and first and second ends and movable from the safe position to the armed position;

a receptor charge having a longitudinal axis that is substantially collinear with the longitudinal axis of the input explosive row;

wherein, in the safe position, the transfer charge is remote from both the input explosive row and the receptor charge; and wherein, in the armed position, the input explosive row is adjacent the first end of the transfer charge to thereby initiate the transfer charge, the longitudinal axis of the input explosive row is substantially collinear with the longitudinal axis of the transfer charge, the second end of the transfer charge is adjacent the receptor charge to thereby initiate the receptor charge and the longitudinal axis of the transfer charge is substantially collinear with the longitudinal axis of the receptor charge;

a spot charge disposed adjacent and perpendicular to the input explosive row, for initiating the input explosive row;

an initiator chip disposed adjacent the spot charge, for initiating the spot charge; an output charge disposed adjacent the receptor charge, the receptor charge initiating the output charge;

an output housing that contains the output charge; and a safe and arm device layer disposed in the output housing, the safe and arm device layer including an arming mechanism movable between the safe position and the armed position, the transfer charge being disposed in the arming mechanism, the input explosive row and the receptor charge being disposed in the safe and arm device layer; and an initiator board assembly disposed atop the safe and arm device layer and having the spot charge and the initiator chip disposed therein.

24. The safe and arm assembly of claim 23 wherein the transfer charge consists of secondary explosives.

25. The safe and arm assembly of claim 23 wherein the receptor charge consists of secondary explosives.

26. The safe and arm assembly of claim 23 wherein the input explosive row comprises first, second and third charges, the first charge initiating the second charge, the second charge initiating the third charge and the third charge initiating the transfer charge.

27. The safe and arm assembly of claim 26 wherein the first charge consists of primary explosive, the second charge consists of primary explosive and the third charge consists of secondary explosive.

* * * * *